US009174789B2

(12) United States Patent
Netzer et al.

(10) Patent No.: US 9,174,789 B2
(45) Date of Patent: Nov. 3, 2015

(54) CONTAINER WITH HEATING FEATURES

(71) Applicant: GRAPHIC PACKAGING INTERNATIONAL, INC., Atlanta, GA (US)

(72) Inventors: Philip E. Netzer, Greenville, WI (US); Terrence P. Lafferty, Neenah, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/211,207

(22) Filed: Mar. 14, 2014

(65) Prior Publication Data

US 2014/0263364 A1 Sep. 18, 2014

Related U.S. Application Data

(60) Provisional application No. 61/852,077, filed on Mar. 15, 2013.

(51) Int. Cl.
*B65D 81/34* (2006.01)

(52) U.S. Cl.
CPC .... *B65D 81/3453* (2013.01); *B65D 2581/3406* (2013.01); *B65D 2581/3456* (2013.01); *B65D 2581/3489* (2013.01); *B65D 2581/3494* (2013.01)

(58) Field of Classification Search
CPC ..... B65D 81/3453; B65D 2581/3406; B65D 2581/3456; B65D 2581/3489
USPC ..... 220/575, 604, 608, 669, 670, 672, 674, 220/913; 99/646 C
See application file for complete search history.

(56) References Cited

U.S. PATENT DOCUMENTS

| | | | |
|---|---|---|---|
| 2,699,866 | A | 1/1955 | Russell |
| 2,859,122 | A | 11/1958 | Maturi et al. |
| 3,085,683 | A | 4/1963 | Harrison |
| 3,200,944 | A | 8/1965 | Rapata |
| 3,224,576 | A | 12/1965 | Whiteford |
| 3,227,272 | A | 1/1966 | Critzer |

(Continued)

FOREIGN PATENT DOCUMENTS

| | | |
|---|---|---|
| AU | 635667 | 3/1993 |
| CA | 1279902 | 2/1991 |

(Continued)

OTHER PUBLICATIONS

International Search Report and Written Opinion for PCT/US2014/027503 dated Jul. 25, 2014.

(Continued)

*Primary Examiner* — Robert J Hicks
*Assistant Examiner* — Kareen Thomas
(74) *Attorney, Agent, or Firm* — Womble Carlyle Sandridge & Rice, LLP

(57) ABSTRACT

A container formed from a blank comprising a base layer and a lamination layer. The container has a bottom wall, a side wall, and a rolled edge extending from the side wall. The container includes features for helping to direct moisture from an interior surface of the bottom wall of the container to the side wall. The features comprise a plurality of embossed features and linear features extending in at least a portion of the container and defining respective grooves in an interior surface of the container defined by the bottom wall and the side wall.

36 Claims, 13 Drawing Sheets

(56) References Cited

U.S. PATENT DOCUMENTS

| | | | | |
|---|---|---|---|---|
| 3,351,264 | A | 11/1967 | Bostrom | |
| 3,443,685 | A | 5/1969 | Wanderer | |
| 3,601,253 | A | 8/1971 | Poupitch | |
| 3,708,086 | A * | 1/1973 | Colato | 220/575 |
| 3,965,323 | A | 6/1976 | Forker, Jr. et al. | |
| 4,175,483 | A | 11/1979 | Clark | |
| 4,593,818 | A | 6/1986 | Schenkman | |
| 4,606,496 | A | 8/1986 | Marx et al. | |
| 4,609,140 | A | 9/1986 | Van Handel et al. | |
| 4,638,941 | A | 1/1987 | Watson | |
| 4,712,676 | A | 12/1987 | Randall | |
| 4,721,499 | A | 1/1988 | Marx et al. | |
| 4,721,500 | A | 1/1988 | Van Handel et al. | |
| 4,739,884 | A | 4/1988 | Duplessy | |
| 4,775,771 | A | 10/1988 | Pawlowski | |
| 4,777,053 | A | 10/1988 | Tobelmann et al. | |
| 4,794,005 | A | 12/1988 | Swiontek | |
| 4,831,224 | A | 5/1989 | Keefer | |
| 4,832,676 | A | 5/1989 | Johns et al. | |
| 4,848,573 | A | 7/1989 | Salacuse | |
| 4,862,791 | A | 9/1989 | Baughey | |
| 4,865,921 | A | 9/1989 | Hollenberg | |
| 4,866,234 | A | 9/1989 | Keefer | |
| 4,870,233 | A | 9/1989 | McDonald et al. | |
| 4,888,459 | A | 12/1989 | Keefer | |
| 4,896,774 | A | 1/1990 | Hammett et al. | |
| 4,916,280 | A | 4/1990 | Havette | |
| 4,936,935 | A | 6/1990 | Beckett | |
| 4,963,424 | A | 10/1990 | Beckett | |
| 5,026,958 | A | 6/1991 | Palacios | |
| 5,093,364 | A | 3/1992 | Richards | |
| 5,117,078 | A | 5/1992 | Beckett | |
| 5,213,902 | A | 5/1993 | Beckett | |
| 5,217,768 | A | 6/1993 | Walters et al. | |
| 5,221,419 | A | 6/1993 | Beckett | |
| 5,246,113 | A | 9/1993 | Schuster | |
| 5,260,537 | A | 11/1993 | Beckett | |
| 5,266,386 | A | 11/1993 | Beckett | |
| 5,298,708 | A | 3/1994 | Babu et al. | |
| 5,310,977 | A | 5/1994 | Stenkamp et al. | |
| 5,310,980 | A | 5/1994 | Beckett | |
| 5,317,118 | A | 5/1994 | Brandberg et al. | |
| RE34,683 | E | 8/1994 | Maynard | |
| 5,340,436 | A | 8/1994 | Beckett | |
| 5,350,904 | A | 9/1994 | Kemske et al. | |
| 5,354,973 | A | 10/1994 | Beckett | |
| 5,410,135 | A | 4/1995 | Pollart | |
| 5,415,340 | A | 5/1995 | Calvert et al. | |
| 5,424,517 | A | 6/1995 | Habeger | |
| 5,519,195 | A | 5/1996 | Keefer | |
| 5,565,228 | A | 10/1996 | Gics | |
| 5,585,027 | A | 12/1996 | Young | |
| 5,628,921 | A | 5/1997 | Beckett | |
| 5,672,407 | A | 9/1997 | Beckett | |
| 5,698,127 | A | 12/1997 | Lai et al. | |
| 5,705,213 | A | 1/1998 | Guillin | |
| 5,759,422 | A | 6/1998 | Schmelzer | |
| 5,800,724 | A | 9/1998 | Habeger | |
| 5,931,333 | A | 8/1999 | Woodnorth et al. | |
| 6,114,679 | A | 9/2000 | Lai | |
| 6,150,646 | A | 11/2000 | Lai | |
| 6,150,647 | A | 11/2000 | Anderson et al. | |
| 6,199,715 | B1 | 3/2001 | Hayes et al. | |
| 6,204,492 | B1 | 3/2001 | Zeng | |
| 6,251,451 | B1 | 6/2001 | Zeng | |
| 6,414,290 | B1 | 7/2002 | Cole | |
| 6,415,944 | B1 | 7/2002 | Toussant | |
| 6,433,322 | B2 | 8/2002 | Zeng | |
| 6,455,827 | B2 | 9/2002 | Zeng | |
| 6,463,844 | B1 | 10/2002 | Wang et al. | |
| 6,501,059 | B1 | 12/2002 | Mast | |
| 6,552,315 | B2 | 4/2003 | Zeng | |
| 6,608,292 | B1 | 8/2003 | Barnes | |
| 6,639,199 | B1 | 10/2003 | Ross, Jr. | |
| 6,651,874 | B1 | 11/2003 | Pedersen | |
| 6,677,563 | B2 | 1/2004 | Lai | |
| 6,717,121 | B2 | 4/2004 | Zeng | |
| 6,765,182 | B2 | 7/2004 | Cole | |
| 6,919,547 | B2 | 7/2005 | Tsontzidis | |
| 6,988,654 | B2 | 1/2006 | Wnek | |
| 7,019,271 | B2 | 3/2006 | Wnek et al. | |
| 7,205,517 | B2 | 4/2007 | Hoh | |
| 7,323,669 | B2 | 1/2008 | Robison et al. | |
| 7,351,942 | B2 | 4/2008 | Wnek et al. | |
| 7,365,292 | B2 | 4/2008 | Cole et al. | |
| 7,476,830 | B2 | 1/2009 | Middleton et al. | |
| 7,541,562 | B2 | 6/2009 | Cole et al. | |
| 8,680,448 | B2 | 3/2014 | Wnek et al. | |
| 8,803,050 | B2 | 8/2014 | Lafferty et al. | |
| 2001/0000732 | A1 | 5/2001 | Hopkins, Sr. | |
| 2001/0021405 | A1 | 9/2001 | Zeng | |
| 2003/0085224 | A1 | 5/2003 | Tsontzidis et al. | |
| 2004/0011860 | A1 | 1/2004 | Lebras | |
| 2004/0262322 | A1 * | 12/2004 | Middleton et al. | 220/675 |
| 2005/0082305 | A1 | 4/2005 | Dais et al. | |
| 2005/0205565 | A1 | 9/2005 | Cole | |
| 2006/0011620 | A1 | 1/2006 | Tsontzidis | |
| 2006/0113300 | A1 | 6/2006 | Wnek | |
| 2007/0029316 | A1 | 2/2007 | Fernandez | |
| 2007/0221666 | A1 | 9/2007 | Keefe et al. | |
| 2008/0000896 | A1 | 1/2008 | Wnek et al. | |
| 2008/0081095 | A1 | 4/2008 | Cole et al. | |
| 2008/0121550 | A1 * | 5/2008 | Anderson et al. | 206/562 |
| 2008/0164178 | A1 | 7/2008 | Wnek et al. | |
| 2009/0206074 | A1 | 8/2009 | Schneider et al. | |
| 2009/0206075 | A1 | 8/2009 | Lafferty | |
| 2010/0278990 | A1 | 11/2010 | Wnek et al. | |
| 2010/0297310 | A1 | 11/2010 | Garbe et al. | |
| 2012/0318810 | A1 * | 12/2012 | Hodge et al. | 220/671 |
| 2014/0263364 | A1 | 9/2014 | Netzer | |

FOREIGN PATENT DOCUMENTS

| | | | |
|---|---|---|---|
| DE | 79 03 283 | | 5/1979 |
| EP | 0 007 522 | | 2/1980 |
| EP | 0 246 041 | | 11/1987 |
| EP | 0 382 399 | | 8/1990 |
| GB | 955883 | | 4/1964 |
| GB | 2 407 153 | | 4/2005 |
| JP | 62-293020 | | 12/1987 |
| JP | 7-33228 | | 6/1995 |
| JP | 10-278974 | A | 10/1998 |
| JP | 2003-95332 | | 4/2003 |
| JP | 2003-137363 | A | 5/2003 |
| JP | 2003-165582 | | 6/2003 |
| JP | 2007-312819 | | 12/2007 |
| KR | 10-0436263 | | 6/2004 |
| KR | 20-0357454 | Y1 | 7/2004 |
| KR | 10-0813904 | | 3/2008 |
| KR | 20-2013-0004074 | U | 7/2013 |
| WO | WO 93/23971 | | 11/1993 |
| WO | WO 95/24110 | | 9/1995 |
| WO | WO 96/22228 | | 7/1996 |
| WO | WO 03/041451 | | 5/2003 |
| WO | WO 2004/020310 | | 3/2004 |
| WO | WO 2005/085091 | | 9/2005 |
| WO | WO 2007/133767 | | 11/2007 |
| WO | WO 2008/144343 | | 11/2008 |
| WO | WO 2008-144343 | A2 | 11/2008 |
| WO | WO 2009/105397 | | 8/2009 |
| WO | WO 2009/105398 | | 8/2009 |
| WO | WO 2010/127214 | | 11/2010 |

OTHER PUBLICATIONS

International Search Report and Written Opinion for PCT/US2014/070488 dated Apr. 20, 2015.

* cited by examiner

CONTAINER WITH HEATING FEATURES

CROSS-REFERENCE TO RELATED APPLICATION

This application claims the benefit of U.S. Provisional Patent Application No. 61/852,077, filed Mar. 15, 2013.

INCORPORATION BY REFERENCE

The disclosure of U.S. Provisional Patent Application No. 61/852,077, which was filed Mar. 15, 2013, is hereby incorporated by reference as if presented herein in its entirety.

BACKGROUND OF THE DISCLOSURE

The present disclosure relates to blanks, containers, trays, constructs, and various features to facilitate forming a container from a blank.

SUMMARY OF THE DISCLOSURE

In one aspect, the disclosure is generally directed to a container for holding a food product. The container comprises a bottom wall and at least one side wall cooperating to at least partially define a cavity of the container. A plurality of first features can extend in the bottom wall, and a plurality of second features can extend in the side wall. The plurality of first features can cooperate with the plurality of second features for directing moisture from the cavity of the container to an exterior of the container during heating of the food product in the cavity of the container.

In another aspect, the present disclosure is generally directed to a blank for forming a container for holding a food product. The blank comprises a bottom portion for forming a bottom wall comprising a plurality of first features extending in the bottom wall when the container formed from the blank. A marginal portion is for forming a side wall comprising a plurality of second features extending in the side wall when the container is formed from the blank. When the container is formed from the blank, the side wall and the bottom wall can cooperate to at least partially define a cavity of the container. The plurality of first features can cooperate with the plurality of second features for directing moisture from the cavity of the container to an exterior of the container during heating of the food product in the cavity of the container formed from the blank.

In another aspect, the present disclosure is generally directed to a method of forming a container for holding a food product. The method comprises obtaining a blank, and forming the container comprising a bottom wall and a side wall from the blank. The forming the container can comprise forming a cavity at least partially defined by the bottom wall and the side wall. The method further comprises forming a plurality of first features extending in the bottom wall and forming a plurality of second features extending in the side wall. The plurality of first features can cooperate with the plurality of second features for directing moisture from the cavity of the container to an exterior of the container during heating of the food product in the cavity of the container.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale.

Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking.

Figure 1:
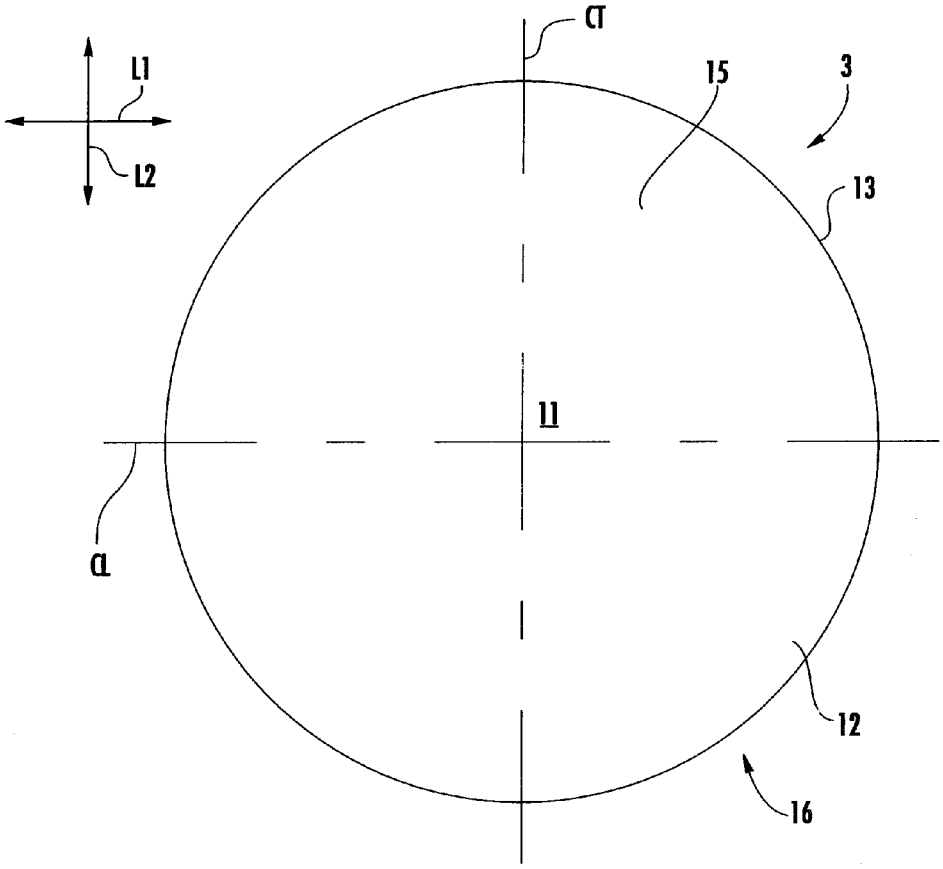
FIG. 1 is a plan view of an interior surface of a blank used for forming a container according to a first embodiment of the disclosure.

FIG. 1 illustrates a blank 3 that is used to form a container 5 (FIGS. 2-4) having a flange 7 according to a first embodiment of the disclosure. In the illustrated embodiment, the blank 3 has generally circular or curved side edges. The blank 3 is for being press formed into the container 5 that, in the illustrated embodiment, is a tray with a generally straight (e.g., vertical) side. It is understood that the blank 3 can be press-formed into the container 5 by a forming tool (not shown) or through a one-step forming process by which the blank is cut from a supply stock and press-formed into the container 5. Also, the forming tool can have similar features and components such as the forming tool disclosed in International Publication No. WO 2008/049048 ("the '048 publication"), the entire contents of which are incorporated by reference for all purposes. Also, the forming tool can have similar features and components such as the forming tool disclosed in U.S. patent application Ser. No. 13/606,385, filed on Sep. 7, 2012, entitled "Tool For Forming A Three Dimensional Article Or Container," ("the '385 application"), the entire contents of which are incorporated by reference for all purposes, or any other suitable forming tool assembly. Also, the blank 3 and the container 5 could be alternatively shaped (e.g., oval, rectangular, irregular, etc.) and/or formed (e.g., through multi-step or single-step tooling processes) or other suitable forming process without departing from the scope of this disclosure.

Figure 1A:
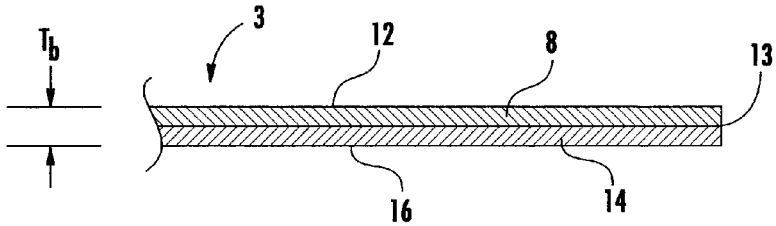
FIG. 1A is a partial cross-section of the blank of FIG. 1.

The blank 3 can be formed from a laminate that includes more than one layer, but alternatively the laminate can be replaced with a single ply of material, such as, but not limited to, paperboard, cardboard, paper, or a polymeric sheet. In accordance with the exemplary embodiments of the present disclosure, the laminate can include a lamination layer 8, which can be a microwave interactive layer with a microwave energy interactive material such as is common in MicroRite® containers available from Graphic Packaging International of Marietta, Ga. The lamination layer can be commonly referred to as, or can have as one of its components, a foil, a microwave shield, or any other term or component that refers to a layer of material suitable for shielding microwave energy and/or causing heating in a microwave oven. Alternatively, the lamination layer 8 can be any suitable material that is laminated onto a substrate. The lamination layer 8 comprises the inner/interior surface 12 of the blank 3 (FIGS. 1 and 1A). In the illustrated embodiment, the blank 3 has a substrate or base layer 14 forming an outer/exterior surface 16 (FIG. 1A) of the blank 3. The lamination layer 8 is supported by, and secured to (e.g., laminated on), the base layer 14, which can be in the form of paperboard, cardboard, polymer, or any other suitable material. Nonetheless and in accordance with the exemplary embodiments, the base layer 14 can be an uncoated paperboard. The lamination layer 8 can be other suitable microwave interactive materials set forth below, or any other suitable material.

As shown in FIG. 1, the blank 3 has a longitudinal direction L1 and a lateral direction L2, wherein a longitudinal centerline CL of the blank 3 is generally parallel to the longitudinal direction L1, and a transverse centerline CT of the blank is generally parallel to the lateral direction L2. The blank 3 has a central portion 11, a marginal portion 15, and an outer edge 13.

In one embodiment, the paperboard base layer 14 of the blank 3 and/or the lamination layer 8 can have a total thickness $T_b$ of approximately less than 0.0065 inch (0.1651 mm). Any of the above noted thicknesses or other dimensions noted above could be larger or smaller than noted or could be inside or outside the listed ranges without departing form the scope of the disclosure. All of the dimensional information presented herein is intended to be illustrative of certain aspects of the disclosure and is not intended to limit the scope of the disclosure, as various other embodiments of the disclosure could include dimensions that are greater than or less than the dimensions included herein.

FIGS. 2-5 show one embodiment of the disclosure comprising a container 5 formed from the blank 3. The container 5 comprises a bottom wall 133, a bottom corner 135 that connects the bottom wall to a side wall 137, an upper corner 139 that connects the side wall 137 to the flange 7, and an outer rolled edge or rolled rim 141. The outer rolled rim 141 generally can include the outer edge 13 of the blank 3, which outer edge 13 has been "rolled under" the flange 7 to form the rolled rim 141. The bottom wall 133 and side wall 137 at least partially define an interior space or cavity 145 of the container 5. In one embodiment, the lamination layer 8 is on the inner/interior surface 12 of the container 5 and the base layer 14 is on the outer/exterior surface 16 of the container. The container 5 is for holding, cooking, and/or heating a food product P (e.g., see for example FIG. 10) that is placed in the interior space 145 of the container.

Figure 2:
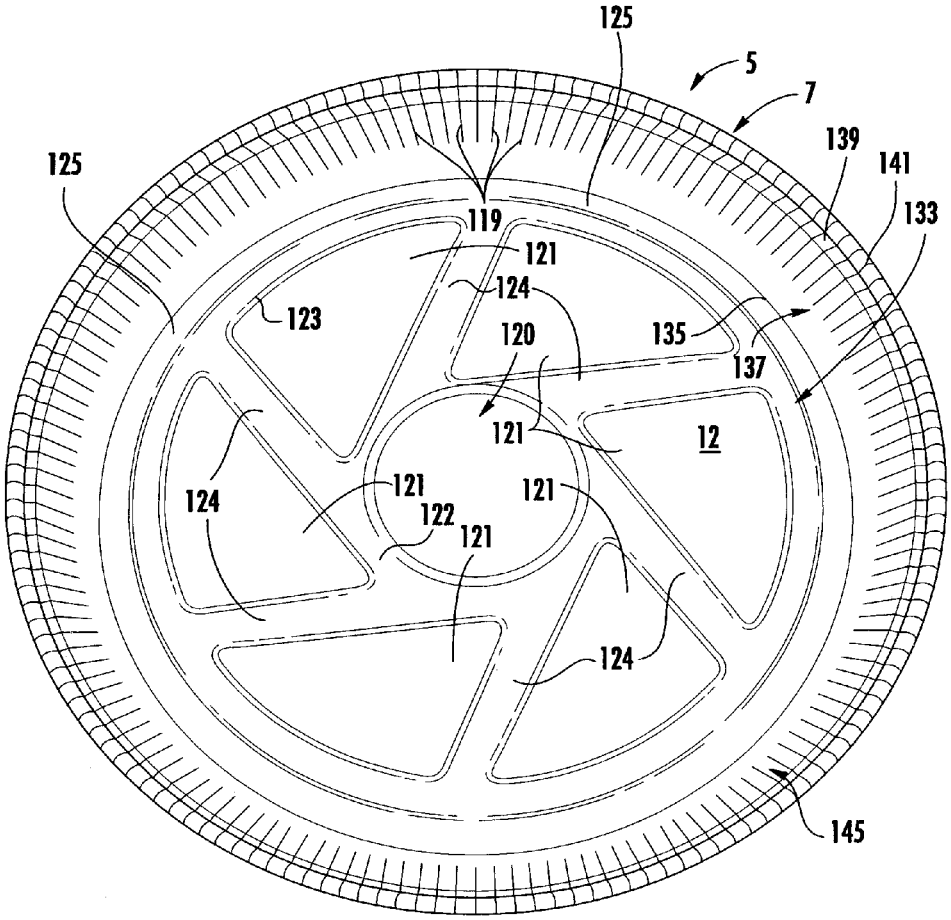
FIG. 2 is a top perspective view of the container according to the first embodiment of the disclosure.
Figure 3:
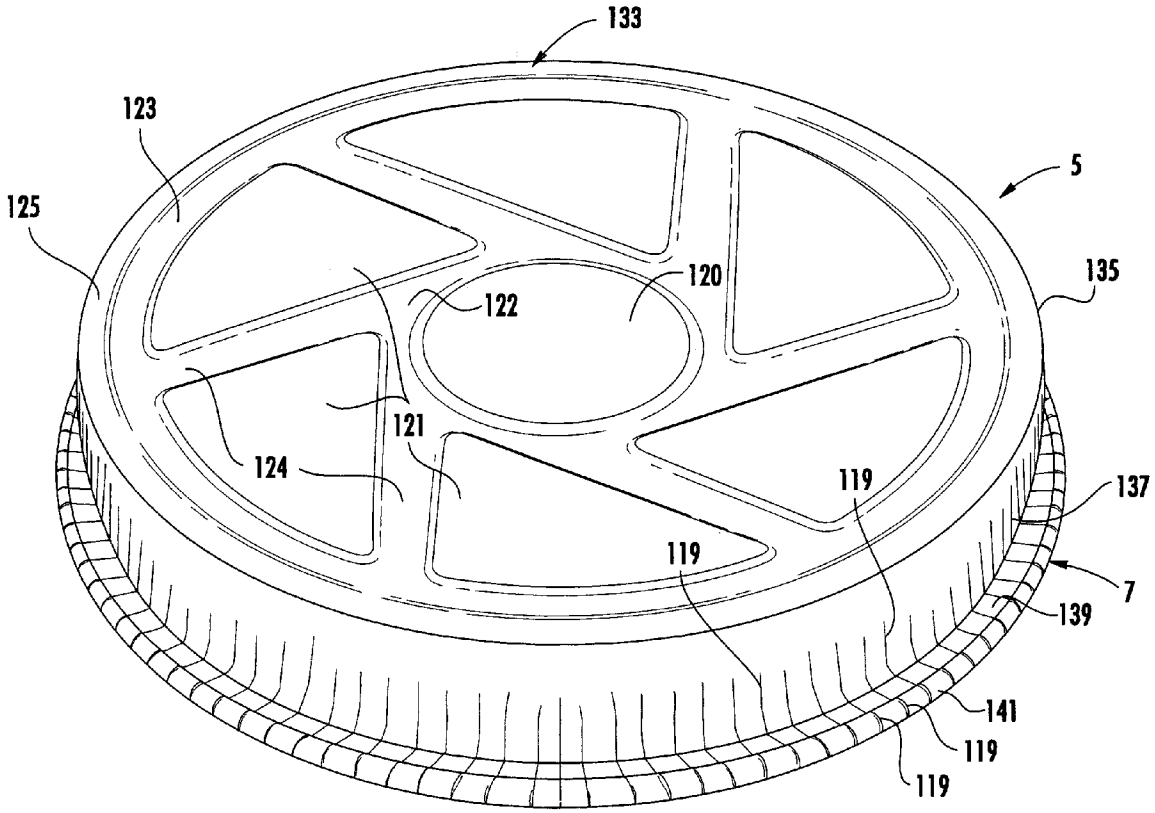
FIG. 3 is a bottom perspective view of the container of FIG. 2.
Figure 4:
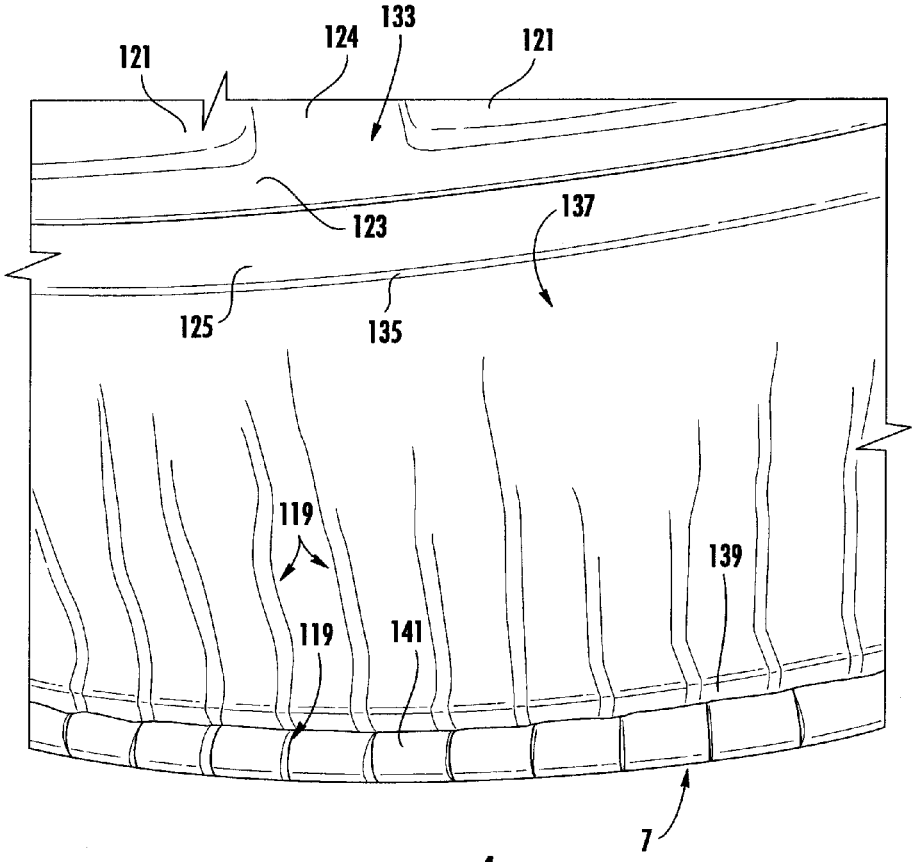
FIG. 4 is an enlarged view of a side wall and flange of the container of FIG. 2.
Figure 5:
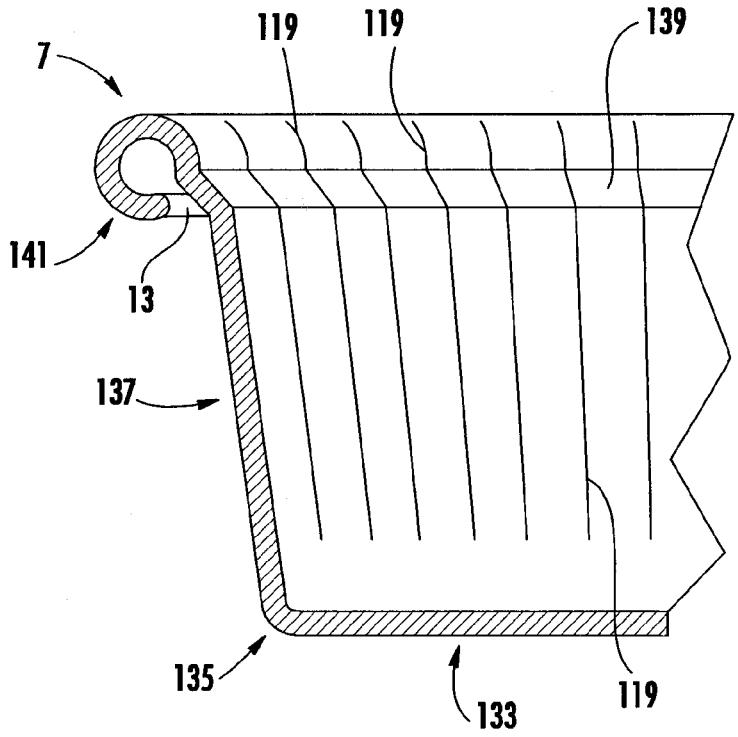
FIG. 5 is a cross-sectional view of a portion of the container of FIG. 2.

As shown in FIGS. 2 and 3, the side wall 137, the flange 7, and the bottom corner 135 are generally curved about the interior space 145. The container 5 could have other shapes and/or dimensions without departing from the disclosure.

As shown in FIGS. 2-5, when the blank 3 is formed into the container 5, pleats 119 form from overlapped portions of the material of the blank 3. In the illustrated embodiment, the pleats 119 are in the rolled rim 141, the flange 7, and the side wall 137, and extend down the side wall to a location proximate the bottom corner 135. The pleats 119 may be generally linear features extending upwardly from an area marginal to the bottom corner 135 towards the flange 7. Thus, the pleats 119 may aid in directing vapor, heat, and/or moisture upwards from the area marginal to the bottom corner 135 from the interior 145 to an area exterior of the container 5. The pleats 119 could be otherwise shaped, arranged, and/or configured without departing from the disclosure.

As shown in FIGS. 2 and 3, the container 5 may further include embossed features 120, 121, 125 formed in the bottom wall 133. Generally, the embossed features 120, 121, 125 can form recessed portions in the interior surface 12 of the bottom wall 133 and can define raised features 122, 123, 124 on the interior surface 12 of the bottom wall 133. In one embodiment, the raised feature 122 can comprise an inner ring that is generally concentric with the inner embossed feature 120, the raised feature 123 can comprise an outer ring that is spaced apart from the side wall 137 by the outer embossed feature 125, and the raised features 124 can generally form arms extending from the inner ring to the outer ring. The raised features 122, 123, 124 may coordinate to separate a bottom portion of a food product from a surface of a microwave oven to aid in even cooking. Further, the inner embossed feature 120 can be a recessed circle, the outer embossed feature 125 can be a recessed ring extending around a perimeter of the bottom wall 133 adjacent the side wall 137, and the intermediate embossed features 121 may be generally triangular features (e.g., triangular recesses) extending radially outward in the bottom wall 133 towards the bottom corner 135 adjacent the arms of the raised features 124. The embossed features 121 and/or the raised features 122, 123, 124 may aid in directing air, vapor, heat, and/or moisture radially outward from the inner embossed feature 120 to the recess formed by the outer embossed feature 125 in the area of the bottom wall marginal to the bottom corner 135. The features 120, 121, 122, 123, 124, 125 could be otherwise shaped, arranged, and/or configured without departing from the scope of this disclosure.

In the illustrated embodiment, the side wall 137 of the container 5 can be substantially vertical and/or substantially perpendicular to the bottom wall 133 so that the interior surface 12 of the side wall 137 can contact a side of the food product P (e.g., for crisping the crust of a deep dish pizza, for providing an additional heating direction for a thick food product, and/or for providing structural support to the sides of a food product). The rolled rim 141 of the flange 7 can provide a location for gripping the container that is strengthened by the rolling of the flange. Accordingly, a user can grasp the container 5 at the rolled rim 141 after heating a food product P and lift the container 5 at the rolled rim 141 without being required to touch the potentially hot bottom wall 133 or side wall 137 to support the container 5 during lifting. Thus the rolled rim 141 can help a user avoid burns while lifting the container.

In one embodiment, during or after heating a food product P for example, moisture and/or air on the bottom wall 133 (e.g., under the food product) and/or moisture and/or air on the side wall 137 (e.g., between the food product and the side wall) can be vented or helped to move to an exterior of the container 5 from the cavity 145 around the food product P by the embossed features 120, 121, 125 in the bottom wall 133 and/or the pleats 119 in the side wall 137. For example, moisture can move toward the outer embossed feature 125 adjacent the side wall 137 in the inner embossed feature 120 and/or the intermediate embossed features 121. In one embodiment, the moisture and/or air additionally or alternatively can move along the raised features 122, 123, 124. Moisture and/or air in the outer embossed feature 125 and/or on the side wall 137 can travel along the linear features formed by the pleats 119 upwardly toward the flange 7 (e.g., by convention forces and/or capillary action) to escape the cavity 145 of the container 5 around the food product P.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure and can be within the listed ranges of dimensions for each feature or outside the listed ranges of dimensions for each feature without departing from the scope of this disclosure.

In one embodiment, the blank 3 is formed into the container 5 by conveying a blank, web, or stock supply and forming the container 5 in a forming tool having a tool assembly or through any other suitable process.

FIGS. 6-9 are different views of a container 205 according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIGS. 6-9, the container 205 is substantially identical to the container 5 of the first embodiment, except that the container 205 includes a plurality of flutes 350 instead of or in addition to pleats 319 in the side wall 337. The pleats 319 can extend in the upper corner 339 and the flange 207. In one embodiment, the pleats 319 can extend at least partially into the side wall 337 from the upper corner 339 (e.g., at respective vertexes of one or more of the flutes 350).

The container 205 comprises a bottom wall 333, a bottom corner 335 that connects the bottom wall to a side wall 337, an upper corner 339 that connects the side wall 337 to the flange 207, and an outer rolled rim 341. The bottom wall 333 and side wall 337 at least partially define an interior space or cavity 345 of the container 205.

As shown in FIGS. 6-9, when the container 205 is formed (e.g., from the blank 3 of FIG. 1), flutes 350 are formed from material of the side wall 337. In the illustrated embodiment, the flutes 350 are in the side wall 337, and extend down the side wall to a location proximate the bottom corner 335. In the illustrated embodiment, as shown for example in FIGS. 6 and 9, the flutes 350 are generally V-shaped with wedge-shaped projections 352 extending between each of the flutes. For example, each flute 350 can comprise the sloped sides 354 of two adjacent wedge-shaped projections 352. In one embodiment, the adjacent sloped sides 354 can form a vertex 356 of the flute 350. The flutes 350 may be generally linear features extending upwardly from an area marginal to the bottom corner 335 towards the flange 207. Thus, the flutes 350 may aid in directing vapor, heat, and/or moisture upwards from the area marginal to the bottom corner 335 from the interior 345 to an area exterior to the container 205. In one embodiment, the flutes 350 form channels in the side wall 337 for allowing air and/or moisture to flow from the bottom corner 335 to the flange 207. The flutes 350 could be otherwise shaped, arranged, and/or configured without departing from the disclosure.

Figure 6:
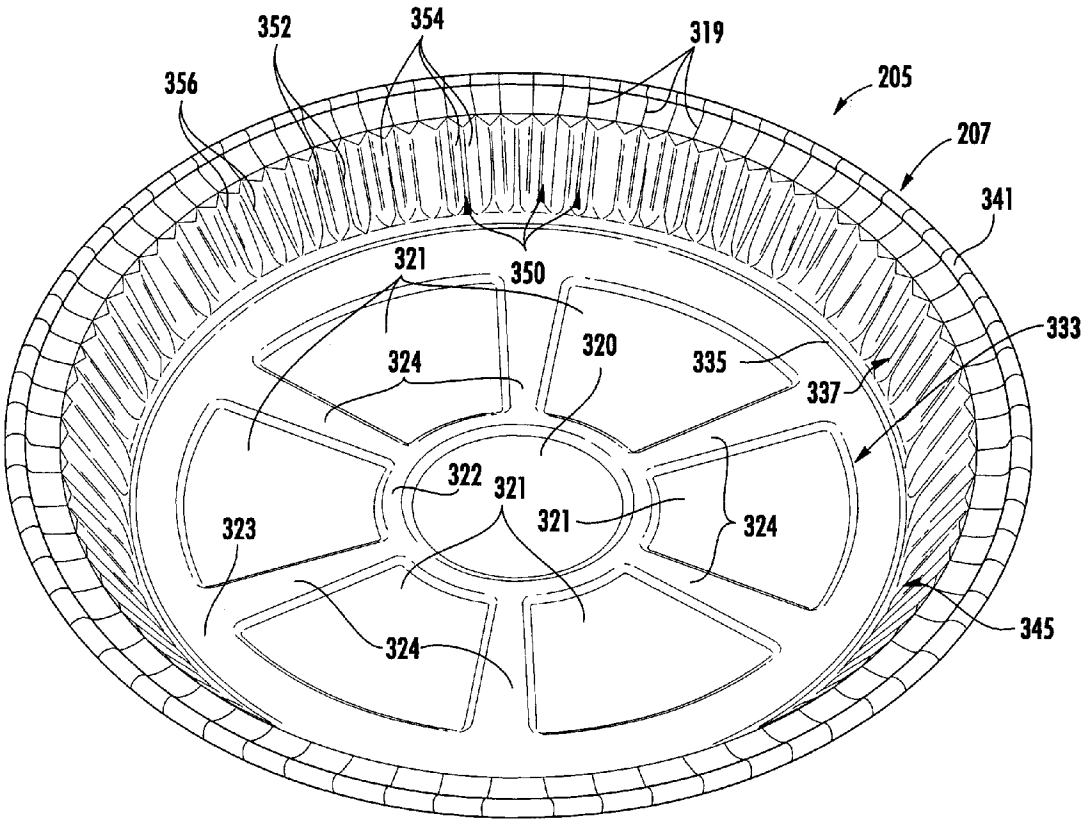
FIG. 6 is a top perspective view of a container according to a second embodiment of the disclosure.
Figure 7:
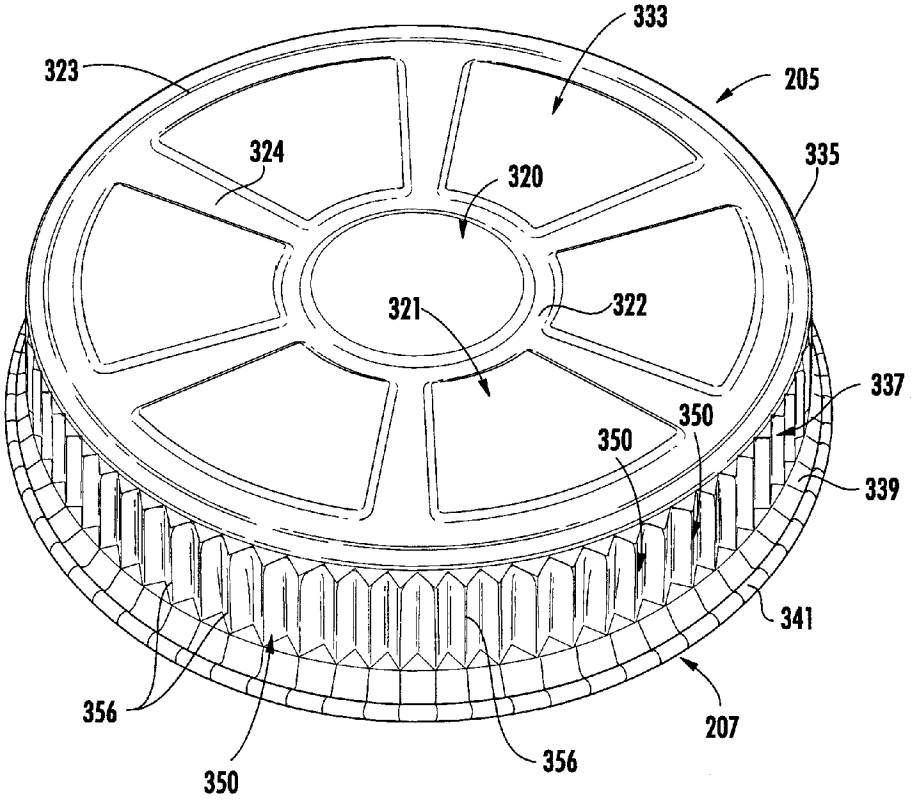
FIG. 7 is a bottom perspective view of the container of FIG. 6.
Figure 8:
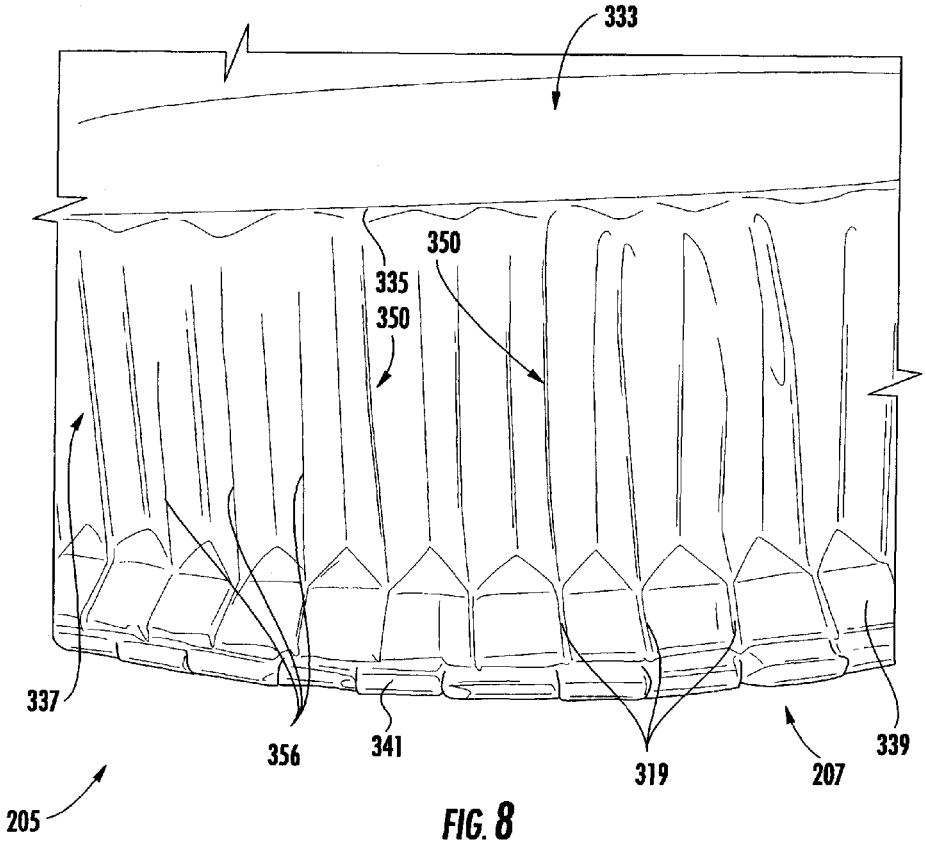
FIG. 8 is an enlarged view of a side wall and flange of the container of FIG. 6.
Figure 9:
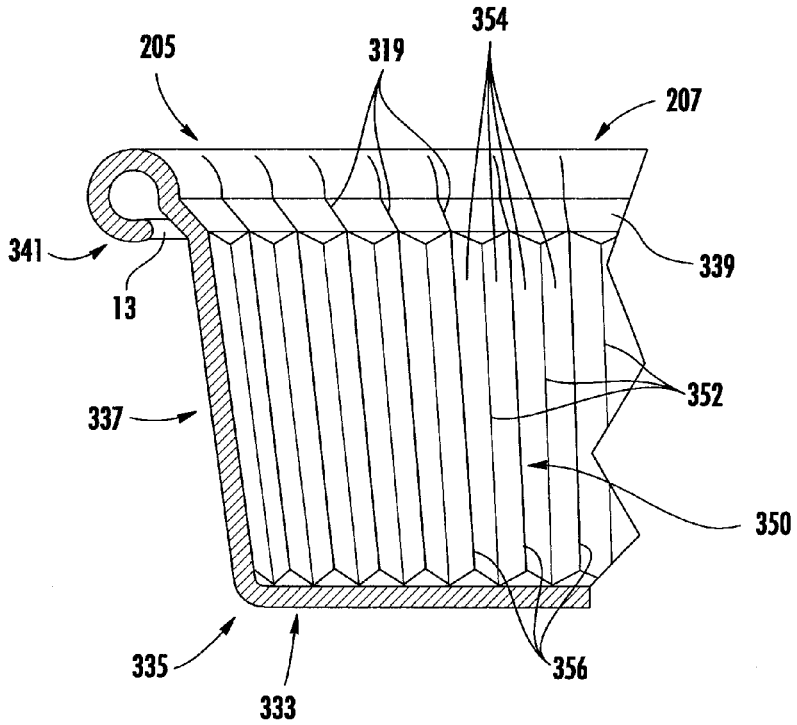
FIG. 9 is a cross-sectional view of a portion of the container of FIG. 6.

As shown in FIGS. 6 and 7, the container 205 may further include embossed features 320, 321 formed in the bottom wall 333. Generally, the embossed features 320, 321 can form recessed portions in the interior surface of the bottom wall 333 and can define raised features 322, 323, 324 on the interior surface of the bottom wall 333. In one embodiment the raised feature 322 can comprise an inner ring that is generally concentric with the inner embossed feature 320, the raised feature 323 can comprise an outer ring that extends adjacent the side wall 337, and the raised features 324 can generally form arms extending from the inner ring to the outer ring. The raised features 322, 323, 324 may coordinate to separate a bottom portion of a food product from a surface of a microwave oven to aid in even cooking. Further, the inner embossed feature 320 can be a recessed circle, and the intermediate embossed features 321 may be generally trapezoidal features extending radially outward in the bottom wall 333 towards the bottom corner 335 adjacent the arms of the raised features 324. The embossed features 321 and/or the raised features 322, 323, 324 may aid in directing air, vapor, heat, and/or moisture radially outward from the feature 320 to the area marginal to the bottom corner 335. The features 320, 321, 322, 323, 324 could be otherwise shaped, arranged, and/or configured without departing from the scope of this disclosure.

Figure 10:
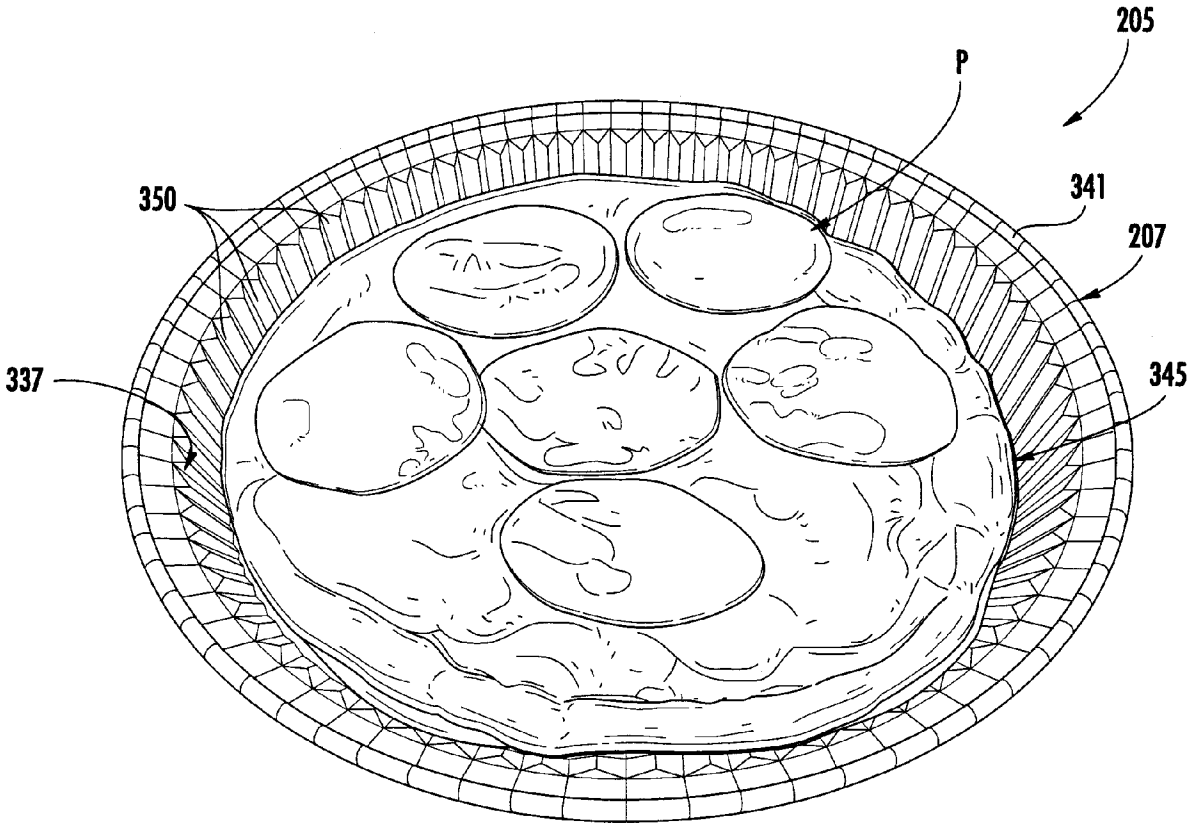
FIG. 10 is a perspective view of the container of FIG. 6 holding a food product according to the second embodiment of the disclosure.

As shown in FIG. 10, a food product P (e.g., a deep dish pizza) can be disposed in the cavity 345 for holding and/or heating. The sides of the food product P can be disposed proximate to the side wall 337, which can be generally vertical, for crisping in one exemplary embodiment. The flutes 350 can provide a pathway for venting of air and/or moisture in the cavity 345 outside the sides of the food product P. The food product P in FIG. 10 is shown by way of example only.

Figure 11:
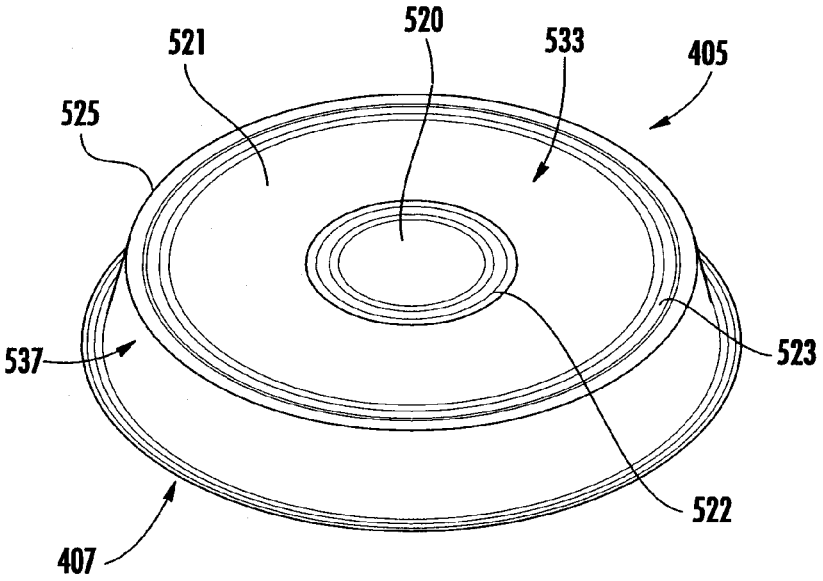
FIG. 11 is a bottom perspective view of a container according to a third embodiment of the disclosure.
Figure 12:
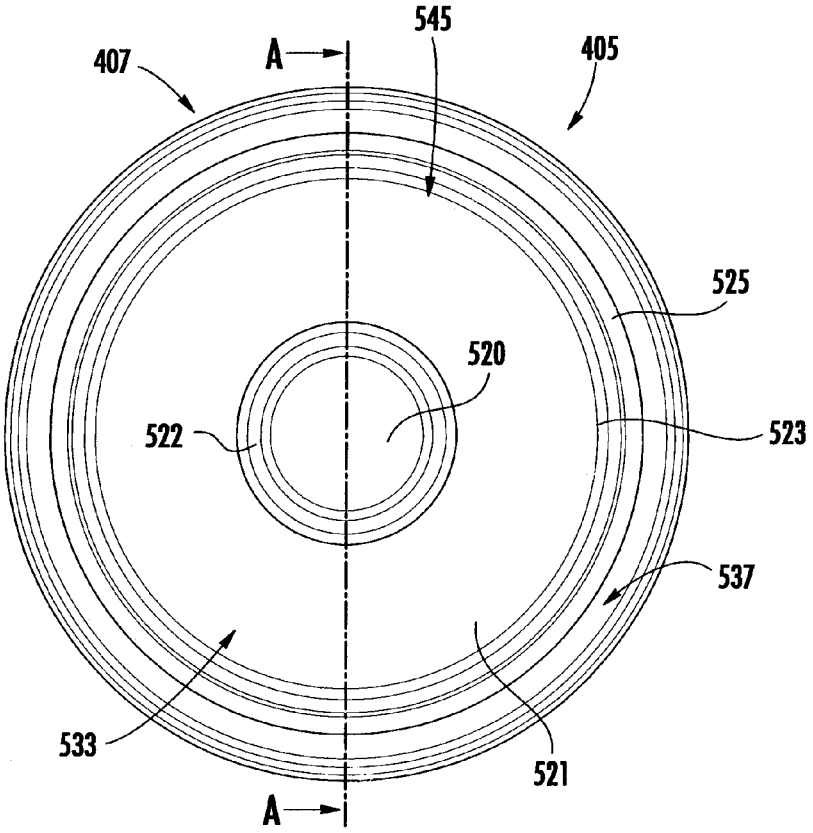
FIG. 12 is a top view of the container of FIG. 11.
Figure 13:
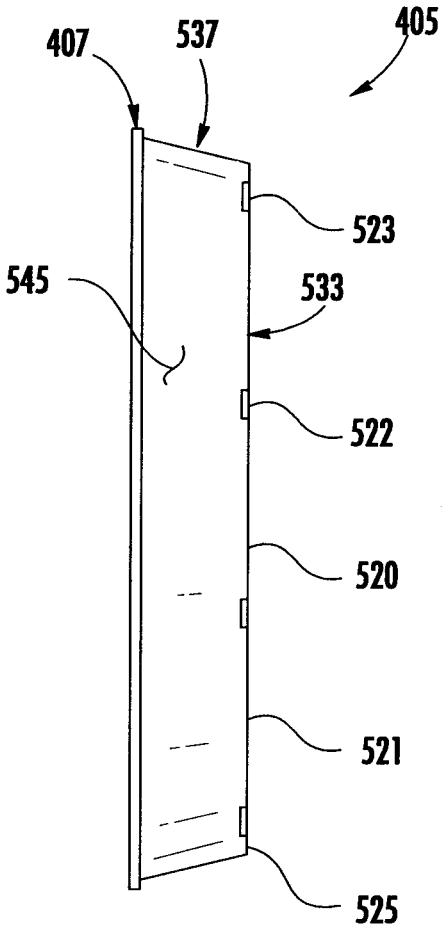
FIG. 13 is a cross-sectional view of the container of FIG. 11 taken at line A-A in FIG. 12.

FIGS. 11-13 are different views of a container 405 according to a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. FIG. 13 is a cross-sectional view of the container 405 taken along line A-A of FIG. 12 and showing an interior surface of the side wall 537 in the interior 545 of the container. As shown in FIGS. 11-13, the container 405 includes embossed features 520, 521, 525, which can form recessed portions in the interior surface of the bottom wall 533 of the container 405. In the illustrated embodiment, the inner embossed feature 520 can form a recessed circle generally in the center of the bottom wall 533, the intermediate embossed feature 521 can form an intermediate recessed ring, and the outer embossed feature 525 can form an outer recessed ring extending along a perimeter of the bottom wall 533 adjacent the side wall 537 of the container 405. The embossed features can define two raised features 522, 523 in the interior surface of the bottom wall 533 in the illustrated embodiment. The inner raised feature 522 can form an inner raised ring disposed between the inner embossed feature 520 and the intermediate embossed feature 521, and the outer raised feature 523 can form an outer raised ring disposed between the intermediate embossed feature 521 and the outer embossed feature 525. As shown in FIGS. 11-13, the outer raised feature 523 can be spaced apart from the side wall 537 by the outer embossed feature 525. The recessed features and the raised features are shown, for example, in the cross-section of the bottom wall 533 in FIG. 13. Any of the features 520, 521, 522, 523, 525 could be otherwise shaped, arranged, and/or configured without departing from the scope of this disclosure.

In one embodiment, the container 405 could include pleats and/or flutes in the side wall 537 and/or the flange 407 similar to the pleats and flutes of the first and/or second embodiments. Alternatively, the pleats and/or the flutes could be omitted. The container 405 could be otherwise shaped, arranged, and/or configured without departing from the scope of this disclosure.

Any of the features of the various embodiments of the disclosure can be combined with, replaced by, or otherwise configured with other features of other embodiments of the disclosure without departing from the scope of this disclosure.

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

Further, the containers disclosed herein may cooperate with a lid (not shown) for heating and/or cooking a food product that is held in the container without departing from the disclosure.

Any of the blanks, containers, or other constructs of this disclosure may optionally include one or more features that alter the effect of microwave energy during the heating or cooking of a food item that is associated with the tray or other construct. For example, the blank, tray, container, or other construct may be formed at least partially from one or more microwave energy interactive elements (hereinafter sometimes referred to as "microwave interactive elements") that promote heating, browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

In the case of a susceptor or shield, the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

The use of other microwave energy interactive elements is also contemplated. In one example, the microwave energy interactive element may comprise a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas may be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor.

As still another example, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. No. 5,412,187, U.S. Pat. No. 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A container for holding a food product, the container comprising:

a bottom wall and at least one side wall cooperating to at least partially define a cavity of the container;

a plurality of first features extending in the bottom wall;

a plurality of second features extending in the side wall, the plurality of first features cooperating with the plurality of second features for directing moisture from the cavity of the container to an exterior of the container during heating of the food product in the cavity of the container; and wherein the plurality of first features comprises embossed features that define a plurality of recessed portions and a plurality of raised portions, the plurality of raised portions comprising an inner ring and an outer ring, and the plurality of recessed portions comprises an inner recessed portion that is generally concentric with the inner ring of the plurality of raised portions and a plurality of intermediate recessed portions disposed between the inner ring and the outer ring of the plurality of raised portions.

2. The container of claim 1, wherein the plurality of second features comprises a plurality of pleats formed in the side wall.

3. The container of claim 1, wherein the plurality of first features comprises embossed features that define a recessed portion in the bottom wall and a raised portion in the bottom wall, the raised portion being for at least partially supporting the food product in the cavity of the container.

4. The container of claim 3, wherein the recessed portion is disposed adjacent the side wall along at least a portion of an outer perimeter of the bottom wall.

5. The container of claim 4, wherein the raised portion comprises a ring spaced apart from the side wall by the recessed portion.

6. The container of claim 1, wherein the plurality of raised portions comprises a plurality of arms extending from the inner ring to the outer ring adjacent the plurality of intermediate recessed portions.

7. The container of claim 6, wherein the plurality of recessed portions comprises an outer recessed portion disposed adjacent the side wall, the outer ring of the plurality of raised portions being spaced apart from the side wall by the outer recessed portion.

8. The container of claim 1, wherein the plurality of second features comprises a plurality of flutes extending in the side wall.

9. The container of claim 8, wherein each flute of the plurality of flutes is at least partially defined by two adjacent wedge-shaped projections on an interior surface of the side wall.

10. The container of claim 9, wherein the flutes are generally V-shaped.

11. The container of claim 1, wherein at least a portion of the side wall is generally perpendicular to the bottom wall so that the side wall is generally vertical.

12. The container of claim 1, further comprising a flange extending from an upper portion of the side wall, the flange extending generally outwardly from the side wall.

13. The container of claim 12, wherein the flange comprises a rolled rim.

14. The container of claim 1, further comprising a lamination layer at least partially secured to a base layer, the lamination layer comprising a microwave energy interactive material.

15. A blank for forming a container for holding a food product, the blank comprising:

a bottom portion for forming a bottom wall comprising a plurality of first features extending in the bottom wall when the container is formed from the blank;

a marginal portion for forming a side wall comprising a plurality of second features extending in the side wall when the container is formed from the blank;

the side wall and the bottom wall cooperate to at least partially define a cavity of the container, and the plurality of first features cooperate with the plurality of second features for directing moisture from the cavity of the container to an exterior of the container during heating of the food product in the cavity of the container formed from the blank; and wherein the plurality of first features comprises embossed features that define a plurality of recessed portions and a plurality of raised portions when the container is formed from the blank, the plurality of raised portions comprising an inner ring and an outer ring when the container is formed from the blank, and the plurality of recessed portions comprises an inner recessed portion that is for being generally concentric with the inner ring of the plurality of raised portions and a plurality of intermediate recessed portions are for being disposed between the inner ring and the outer ring of the plurality of raised portions when the container is formed from the blank.

16. The blank of claim 15, wherein the plurality of second features comprises a plurality of pleats formed in the side wall when the container is formed from the blank.

17. The blank of claim 15, wherein the plurality of first features comprises embossed features that define a recessed portion in the bottom wall and a raised portion in the bottom wall when the container is formed from the blank.

18. The blank of claim 17, wherein the recessed portion is for being disposed adjacent the side wall along at least a portion of an outer perimeter of the bottom wall when the container is formed from the blank, and the raised portion comprises a ring for being spaced apart from the side wall by the recessed portion when the container is formed from the blank.

19. The blank of claim 15, wherein the plurality of raised portions comprises a plurality of arms being for extending from the inner ring to the outer ring adjacent the plurality of intermediate recessed portions when the container is formed from the blank.

20. The blank of claim 19, wherein the plurality of recessed portions comprises an outer recessed portion for being disposed adjacent the side wall when the container is formed from the blank, the outer ring of the plurality of raised portions are for being spaced apart from the side wall by the outer recessed portion when the container is formed from the blank.

21. The blank of claim 15, wherein the plurality of second features comprises a plurality of flutes being for extending in the side wall when the container is formed from the blank.

22. The blank of claim 15, wherein at least a portion of the side wall is for being generally perpendicular to the bottom wall so that the side wall is generally vertical when the container is formed from the blank.

23. The blank of claim 15, wherein the marginal portion is for forming a flange extending from an upper portion of the side wall when the container is formed from the blank.

24. The blank of claim 23, wherein the flange comprises a rolled rim when the container is formed from the blank.

25. The blank of claim 15, further comprising a lamination layer at least partially secured to a base layer, the lamination layer comprising a microwave energy interactive material.

26. A method of forming a container for holding a food product, the method comprising:

obtaining a blank;

forming the container comprising a bottom wall and a side wall from the blank, wherein the forming the container comprises forming a cavity at least partially defined by the bottom wall and the side wall;

forming a plurality of first features extending in the bottom wall; and forming a plurality of second features extending in the side wall, the plurality of first features cooperating with the plurality of second features for directing moisture from the cavity of the container to an exterior of the container during heating of the food product in the cavity of the container; and wherein the plurality of first features comprises embossed features that define a plurality of recessed portions and a plurality of raised portions, the plurality of raised portions comprising an inner ring and an outer ring, and the plurality of recessed portions comprises an inner recessed portion that is generally concentric with the inner ring of the plurality of raised portions and a plurality of intermediate recessed portions disposed between the inner ring and the outer ring of the plurality of raised portions.

27. The method of claim 26, wherein the forming the plurality of second features comprises forming a plurality of pleats in the side wall.

28. The method of claim 26, wherein the forming the plurality of first features comprises forming embossed features that define a recessed portion in the bottom wall and a raised portion in the bottom wall, the raised portion being for at least partially supporting the food product in the cavity of the container.

29. The method of claim 28, wherein the forming the embossed features comprises disposing the recessed portion adjacent the side wall along at least a portion of an outer perimeter of the bottom wall.

30. The method of claim 26, wherein the plurality of raised portions comprises a plurality of arms extending from the inner ring to the outer ring adjacent the plurality of intermediate recessed portions.

31. The method of claim 30, wherein the plurality of recessed portions comprises an outer recessed portion disposed adjacent the side wall, the outer ring of the plurality of raised portions being spaced apart from the side wall by the outer recessed portion.

32. The method of claim 26, wherein the forming the plurality of second features comprises forming a plurality of flutes extending in the side wall.

33. The method of claim 32, wherein the forming the plurality of flutes comprises forming a plurality of wedge-shaped projections on an interior surface of the side wall so that each flute of the plurality of flutes is at least partially defined by two adjacent wedge-shaped projections of the plurality of wedge-shaped projections.

34. The method of claim 26, wherein the forming the container comprises disposing at least a portion of the side wall generally perpendicular to the bottom wall so that the side wall is generally vertical.

35. The method of claim 26, wherein the forming the container further comprises forming a flange extending from an upper portion of the side wall so that the flange extends generally outwardly from the side wall, the forming the flange comprising forming a rolled rim.

36. The method of claim 26, wherein the blank comprises a lamination layer at least partially secured to a base layer, the lamination layer comprising a microwave energy interactive material.

* * * * *